US012042115B1

(12) United States Patent
Krenzien et al.

(10) Patent No.: US 12,042,115 B1
(45) Date of Patent: Jul. 23, 2024

(54) CUTLERY RACK FOR A DISHWASHER

(71) Applicant: Miele & Cie. KG, Guetersloh (DE)

(72) Inventors: Henning Krenzien, Hilter (DE); Eugen Sgurski, Lage (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 18/570,686

(22) PCT Filed: Jun. 10, 2022

(86) PCT No.: PCT/EP2022/065785
§ 371 (c)(1),
(2) Date: Dec. 15, 2023

(87) PCT Pub. No.: WO2023/274681
PCT Pub. Date: Jan. 5, 2023

(30) Foreign Application Priority Data

Jun. 30, 2021 (DE) ..... 10 2021 116 816.3

(51) Int. Cl.
*A47L 15/50* (2006.01)

(52) U.S. Cl.
CPC ..... *A47L 15/502* (2013.01); *A47L 15/50* (2013.01); *A47L 15/503* (2013.01)

(58) Field of Classification Search
CPC ..... A47L 15/50; A47L 15/502; A47L 15/503; A47L 15/505
See application file for complete search history.

(56) References Cited

U.S. PATENT DOCUMENTS

| | | | | |
|---|---|---|---|---|
| D817,563 | S * | 5/2018 | Lee | A47L 15/50 D32/3 |
| 2010/0117498 | A1 | 5/2010 | Leinmueller et al. | |
| 2014/0174486 | A1* | 6/2014 | Fey | A47L 15/503 134/135 |
| 2015/0320290 | A1* | 11/2015 | Hederstierna | A47L 15/505 211/41.9 |
| 2017/0280966 | A1* | 10/2017 | Kilic | A47L 15/503 |
| 2018/0125330 | A1* | 5/2018 | Naik | A47L 15/0084 |
| 2018/0242816 | A1* | 8/2018 | Cao | A47L 15/50 |

FOREIGN PATENT DOCUMENTS

| | | | |
|---|---|---|---|
| CN | 204618156 | U | 9/2015 |
| CN | 204950862 | U | 1/2016 |
| CN | 109662675 | A | 4/2019 |
| DE | 102007017115 | A1 | 10/2008 |
| EP | 3409182 | A1 | 12/2018 |

* cited by examiner

*Primary Examiner* — Kimberley S Wright
(74) *Attorney, Agent, or Firm* — LEYDIG, VOIT & MAYER, LTD.

(57) ABSTRACT

A cutlery rack for a dishwasher includes: a rack body which is mounted so as to be withdrawn from a washing chamber of the dishwasher in a direction of withdrawal and provides a cutlery insert for accommodating in particular cutlery pieces, the cutlery insert having a row of tines for separately receiving cutlery pieces that are oriented transversely to the direction of withdrawal, which row of tines includes a plurality of tines arranged one behind another in the direction of withdrawal, adjacent tines being spaced apart from one another, forming a gap. The row of tines has two tine ridges extending in the direction of withdrawal and being spaced apart from each other transversely to the direction of withdrawal, leaving a gap space. A tine strip is provided which is received in the gap space between the two tine ridges.

11 Claims, 12 Drawing Sheets

CUTLERY RACK FOR A DISHWASHER

CROSS-REFERENCE TO PRIOR APPLICATIONS

This application is a U.S. National Phase application under 35 U.S.C. § 371 of International Application No. PCT/EP2022/065785, filed on Jun. 10, 2022, and claims benefit to German Patent Application No. DE 10 2021 116 816.3, filed on Jun. 30, 2021. The International Application was published in German on Jan. 5, 2023 as WO/2023/274681 A1 under PCT Article 21(2).

FIELD

The invention relates to a cutlery rack for a dishwasher, including a rack body which is mounted so that it can be withdrawn from a washing chamber of the dishwasher in the direction of withdrawal and provides a cutlery insert for accommodating in particular cutlery pieces, the cutlery insert having a row of tines for separately receiving cutlery pieces that are oriented transversely to the direction of withdrawal, which row includes a plurality of tines arranged one behind the other in the direction of withdrawal, adjacent tines being spaced apart from one another, forming a gap.

BACKGROUND

A cutlery rack of this type is known, for example, from the EP 3 409 182 A1.

The cutlery rack known from EP 3 409 182 A1 has a frame-shaped rack body providing a total of three cutlery inserts. The rack body is configured so as to be movable out of and into the washing chamber of the dishwasher, together with the cutlery inserts received by the rack body.

Tines arranged in rows are provided for separately receiving cutlery pieces, adjacent tines being spaced apart from one another, forming a gap. During normal use, the gap formed between two adjacent tines receives a portion of a cutlery piece. Preferably, two rows of tines are provided to allow secure positioning of a plurality of cutlery pieces, the two rows of tines being arranged adjacent each other in the direction of withdrawal of the cutlery rack, and the tines of a respective row of tines extending one behind the other in the direction of withdrawal.

The aforedescribed design allows the user to easily load the cutlery rack with cutlery pieces in separated relation. For this purpose, the cutlery pieces are each placed between two adjacent tines of a row of tines and aligned transversely, preferably orthogonally, to the direction of withdrawal of the cutlery rack.

Although the aforedescribed design has proven practical in everyday use, it still has disadvantages. For example, it has been found that after years of proper use, cutlery pieces may accidentally be damaged, especially as a result of scratching. This is for two different reasons. Firstly, the known design does not always allow the supported cutlery pieces to be securely held in position, as a result of which cutlery pieces arranged adjacent each other in the cutlery insert may knock against each other during a wash cycle. Secondly, a cutlery insert is made of a robust and, therefore, typically relatively hard plastic material, especially for reasons of durability, which can lead to undesirable abrasion phenomena and/or formation of scratches on cutlery pieces, especially over the long term.

SUMMARY

In an embodiment, the present invention provides a cutlery rack for a dishwasher, comprising: a rack body which is mounted so as to be withdrawn from a washing chamber of the dishwasher in a direction of withdrawal and provides a cutlery insert for accommodating in particular cutlery pieces, the cutlery insert having a row of tines for separately receiving cutlery pieces that are oriented transversely to the direction of withdrawal, which row of tines includes a plurality of tines arranged one behind another in the direction of withdrawal, adjacent tines being spaced apart from one another, forming a gap, wherein the row of tines has two tine ridges extending in the direction of withdrawal and being spaced apart from each other transversely to the direction of withdrawal, leaving a gap space, wherein a tine strip is provided which is received in the gap space between the two tine ridges, and wherein a catch device is provided by which the tine strip is securely held in position by the tine ridges, the tine strip projecting beyond the tine ridges toward a gap provided between two adjacent tines and comprising a material that has a lower hardness than a material of the tine ridges.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
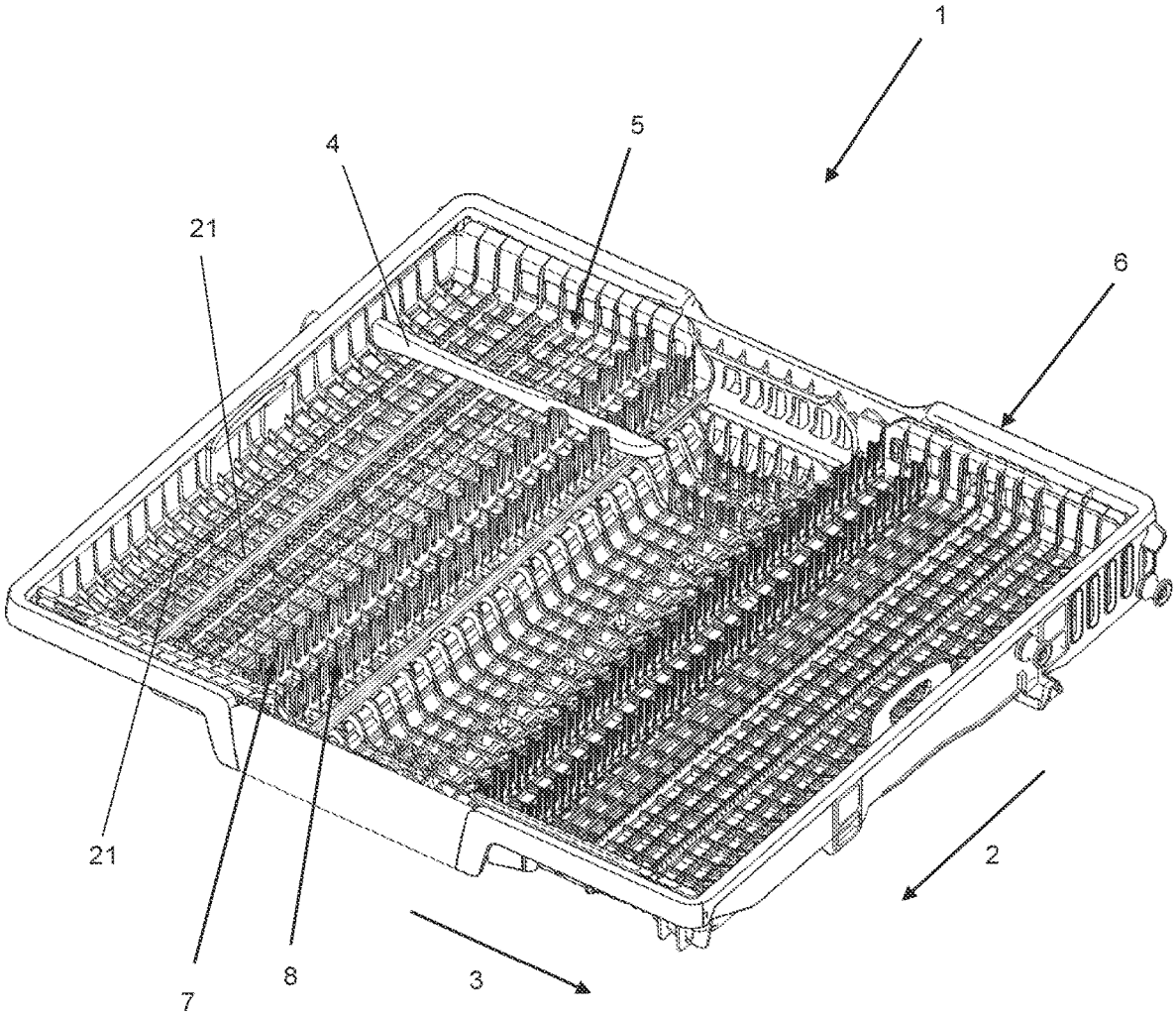
FIG. 1 is a schematic perspective view of a cutlery rack according to the invention.

In an embodiment, the present invention improves the design of a cutlery rack of the above-mentioned type so as to prevent, to the extent possible, accidental damage to cutlery pieces.

In an embodiment, the present invention provides a cutlery rack of the above-mentioned type which is characterized in that the row of tines has two tine ridges extending in the direction of withdrawal and being spaced apart from each other transversely to the direction of withdrawal, leaving a gap space, and in that a tine strip is provided which is received in the gap space between the two tine ridges, and in that a catch device is provided by means of which the tine strip is securely held in position by the tine ridges, the tine strip projecting beyond the tine ridges toward a gap provided between two adjacent tines and being made of a material that has a lower hardness than the material of the tine ridges.

The cutlery insert of the cutlery rack according to the invention has two material components. A relatively soft material component is provided against which the cutlery pieces rest during normal use. This inhibits accidental damage to the cutlery pieces caused by scratching.

The row of tines of the cutlery rack according to the invention has two tine ridges extending in parallel in the direction of withdrawal and being spaced apart from each other. These tine ridges are made of a durable, relatively hard plastic material in a manner known per se. However, in a departure from the prior art, cutlery pieces properly supported on the cutlery rack do not rest directly against these tine ridges. Rather, a tine strip is provided which serves as a seat for the cutlery pieces against which to rest the cutlery pieces. This tine strip is composed of a material that has a lower hardness than the material of the tine ridges. The material of the tine strip is preferably a soft, elastic plastic material, such as, for example, silicone. Thus, during normal use, the cutlery piece rests against this relatively soft plastic material of the silicone strip.

The tine strip is securely held in position in the gap space between the tine ridges. For this purpose, a catch device is provided which positionally fixes the tine strip relative to the tine ridges. This prevents accidental displacement of the tine strip relative to the tine ridges, which always ensures secure seating of a cutlery piece supported on the cutlery rack.

The tine strip is received in the gap space between the two adjacent tine ridges. The tine strip projects beyond the tine ridges toward a gap provided between two adjacent tines so that a seating surface made of the relatively soft plastic material of the tine strip is provided for the cutlery piece.

The result of the inventive design is a row of tines formed by tine ridges, the tine ridges being made of a relatively hard and thus durable plastic material. The tine ridges serve as a supporting and retaining device for a tine strip made of a relatively soft plastic material, which is held in the gap space between the two tine ridges in the final assembled state. The tine strip has a geometric contour such that it protrude beyond the tine strips at the edges thereof and projects into the respective gaps between two adjacent tines. Thus, a supporting contact contour made of a soft, elastic plastic material is provided in each gap for cutlery material, supported by the tine ridges made of relatively hard plastic material. The result is a design that provides a robust and at the same time soft, elastic seating surface for cutlery pieces.

The inventive design provides in particular two advantages. Firstly, the tine strip made of a soft, elastic plastic material provides a seating surface for cutlery material, which ensures that the material of a cutlery piece will not be impaired as a result of the cutlery piece resting on the seating surface. Secondly, due to the soft, elastic design of the tine strip, clamping effects are achieved for a cutlery piece supported by the row of tines. As a result, unlike the prior art, the cutlery piece is securely held in position on the row of tines, which inhibits cutlery pieces from accidentally knocking against each other, especially during a normal wash cycle. Thus, the design according to the invention ensures in two ways that cutlery pieces are gently received and positioned within the inventive cutlery rack.

The catch device provided in accordance with the invention holds the tine strip made of a soft plastic material securely in position in the gap space between the tine ridges. The gap space between the tine ridges takes the form of a slot into which the tine strip is replaceably inserted. The inventive design thus allows the tine strip to be replaced if necessary. This accounts for the fact that that the soft, elastic plastic material of the tine strip may possibly have a shorter service life than the relatively hard plastic material of which the tine ridges are made. Wear damage to the tine strip can thus be accounted for simply by replacement.

The slot-shaped gap space between two tine ridges is preferably open at its vertically lower side, so that a tine strip can be mounted and removed via this open side. During mounting, the tine strip is inserted from below into the slot-shaped gap space and pushed vertically upward therein until it securely snaps into position relative to the tine ridges by means of the catch device according to the invention. In this final mounted position, the catch device holds the tine strip securely in position relative to the tine ridges. Preferably, the tine strip is oversized with respect to the gap width of the gap space, so that secure positioning on the locking ridges is not only achieved by the inventive catch device, but also by the clamping force resulting from the oversized configuration. The tine strip made of a soft, elastic plastic material is thus inserted into the gap space under resilient compression, so that in the final mounted state, the tine strip presses resiliently against the two tine ridges, which each act as an abutment, whereby the tine strip is firmly clamped between the two tine ridges. The catch device acts in addition to this clamping of the tine strip between the two tine ridges, so that the tine strip is securely fixed in position relative to the tine ridges in two ways.

During removal, the tine strip is threaded out of the gap space between the two tine ridges and removed through vertically lower open side in the gap space, in particular using suitable tools. Such removal is performed non-destructively, at least with regard to the tine ridges, so that after such removal, a new tine strip can be mounted in the manner already described.

Another feature of the invention provides that the catch device includes locking hooks on the tine ridges, against which the foot end of the tine strip rests in the final mounted state. Thus, in the final mounted state, a form-fit connection is created by an undercut between the tine ridges and the tine strip. During mounting, the tine strip is inserted from below, head end first, into the slot, which is open at its vertically lower side. In this process, it is pushed vertically upward into the slot until it has been completely moved past the locking hooks of the catch device, so that the foot end thereof comes to rest thereon. The locking hooks thus secure the tine strip from slipping vertically downward out of position relative to the tine ridges.

Another feature of the invention provides that the catch device includes abutments on the tines, the abutments being formed opposite the locking hooks, and the head end of the tine strip bearing thereagainst in the final mounted state.

During mounting, a tine strip is pushed vertically upward in its gap space until its head end abuts against abutments on the tine ridges. In this position, the tine strip has passed the locking hooks at the foot end in the manner already described, and, thus, the tine strip now rests between and against the abutment at the head end and the locking hooks at the foot end. Since the tine strip is made of a soft, elastic plastic material, it is resiliently clamped in place between the abutment and the looking hooks, whereby the tine strip securely held in a fixed position in the vertical direction. The tine strip cannot yield or migrate out upwardly or downwardly.

Another feature of the invention provides that the abutment is formed by a bridging piece that extends transversely to the direction of withdrawal between the tine ridges at each tine. In accordance with this particularly preferred embodiment, the tine ridges are connected via bridging pieces, such a bridging piece being provided at each tine. More particularly, a bridging piece connects two tines of the two tine ridges at the head end, which tines are disposed parallel to (i.e., opposite) each other in a direction orthogonal to the direction of withdrawal. This bridging piece, first of all, provides for a very robust and stable design of the tine ridges, providing in particular stiffness of connection, and, secondly, constitutes an abutment in the manner already described for the tine strip received in the gap space between two tine ridges in the final mounted state.

A further feature of the invention provides that the bridging piece has a rib at its underside facing the tine strips, which rib engages in a correspondingly shaped recess of the tine strip when the tine strip is in the final mounted state. This rib/recess arrangement advantageously causes the tine strip to be securely fixed in position also in the direction of withdrawal. In particular, with this form-fit arrangement, it is achieved that, in the final mounted state, the head end of a tine of the tine strip cannot move in relation to the respectively associated bridging piece. In this way, it is achieved that a cutlery piece properly supported on the cutlery rack and resting against the tine strip does not push the tine strip toward an adjacent gap. The tine strip is thus secured in position in the direction of withdrawal at the head end thereof.

Another feature of the invention provides that the tine ridges each have a guide rib on their facing sides at each tine, each guide rib engaging in a guide groove provided by the tine strip when the tine strip is in the final mounted state. This arrangement has two effects. Firstly, during mounting, the tine strip is guided by the guide ribs of the tine ridges engaging in the associated guide grooves of the tine strip. This ensures positionally accurate insertion of the tine strip into the gap space between the two tine ridges, in particular with regard to the positional association of the individual tines. In the final mounted state, this rib/groove configuration also ensures that the tine strip is securely held in position in relation to the tine ridges in the vertical direction over the entire vertical extent of a tine. In particular, the tine strip cannot be pushed out of the final mounted position and moved in relation to the associated tine ridges by proper placement of cutlery pieces. The rib/groove arrangement thus provides a form-fit connection between the tine ridges and the tine strip by an undercut.

To allow secure positioning of a cutlery piece, a cutlery insert of the inventive type preferably has two rows of tines of the aforedescribed type. Preferably, these are each arranged in the direction of withdrawal and extend one behind the other in a direction orthogonal to the direction of withdrawal.

The cutlery rack according to the invention is further characterized by a second tine strip which is made of a soft, elastic plastic material and spaced apart from the row of tines transversely to the direction of withdrawal. Accordingly, in accordance with this embodiment, not only one or two rows of tines having a respective first tine strip is/are provided, but a second tine strip is also used. This second tine strip is also made of a soft, elastic plastic material, such as, for example, silicone. In the final mounted state, it is oriented in the direction of withdrawal and disposed adjacent to the row or rows of tines transversely thereto. This second tine strip serves to provide another rest or supporting contact surface for a cutlery piece supported on the cutlery rack. In particular, this second tine strip is capable of supporting the handle portion of a cutlery piece, whereas a row of tines as described above serves to support the functional portion of a cutlery piece, such as, for example, the blade of a knife.

In accordance with another feature of the invention, the second tine strip is latchingly mounted on the cutlery insert, for which purpose the cutlery insert has latching strips which, in the final assembled state, engage in grooves provided by the tine strip.

Preferably, the second tine strip is securely held in position on the cutlery insert, namely by form-fit. This is achieved by the latching insert having latching strips which, in the final mounted state, engage in correspondingly shaped grooves of the tine strip. This latching connection is releasable, and thus the second tine strip is also replaceably mounted on the cutlery insert and can be replaced if necessary.

A further feature of the invention provides that the second tine strip provides tines which are arranged one behind the other in the direction of withdrawal, adjacent tines being spaced apart from one another, forming a gap, a gap of the second tine strip being aligned in a direction orthogonal to the direction of withdrawal with a gap between two tines of the row of tines. During normal use, this allows a cutlery piece supported on the cutlery rack to be aligned in a direction orthogonal to the direction of withdrawal. This simplifies handling for the user, especially when loading or unloading the cutlery rack with cutlery pieces. In addition, cutlery pieces can be separated in a defined manner, which leads to an improved cleaning result during normal use of the dishwasher.

The invention also provides a dishwasher of a generally known type which is characterized by a cutlery rack of the inventive type. Such a dishwasher has the advantages already described above with regard to the cutlery rack.

Figure 16:
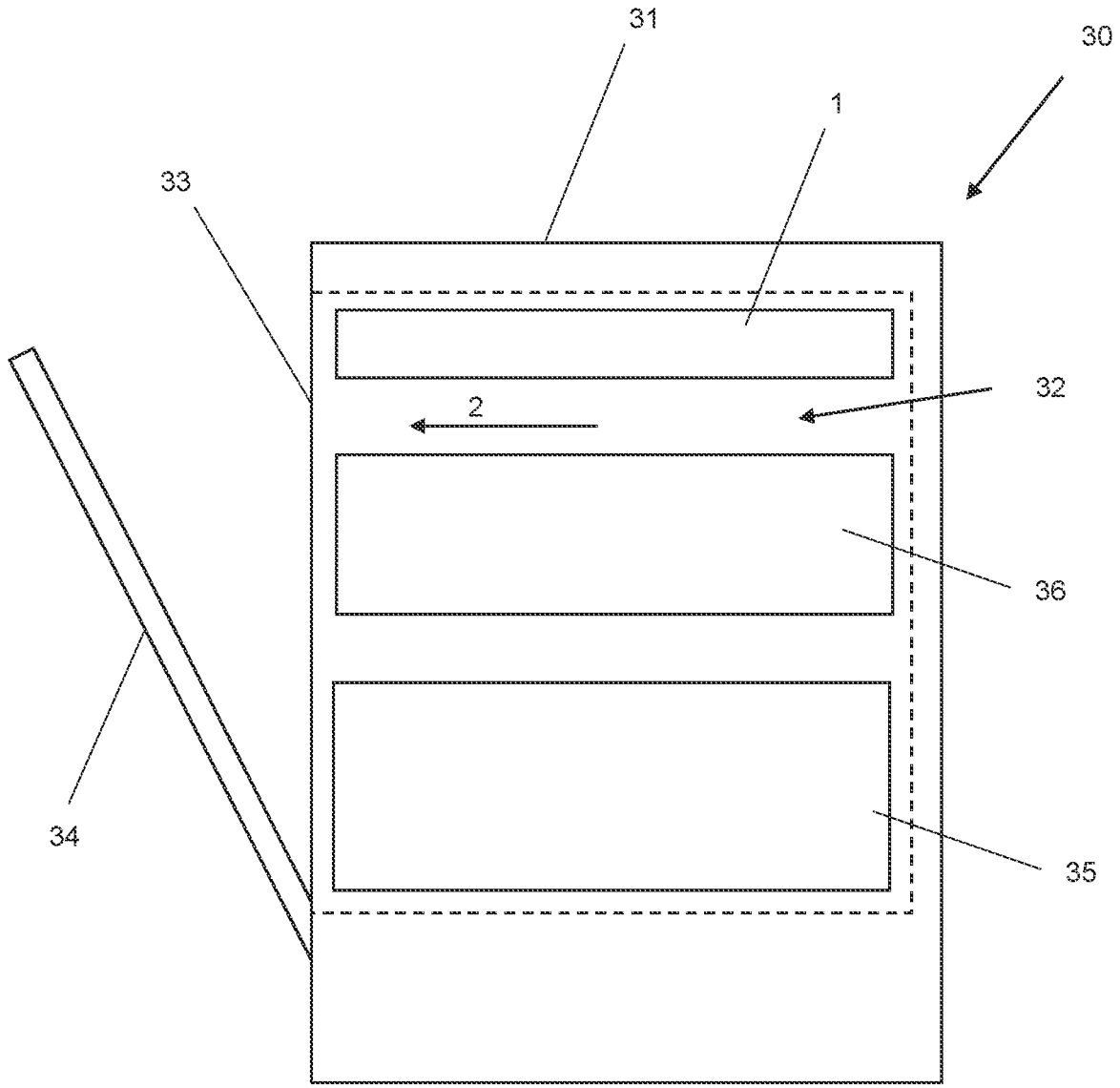
FIG. 16 is a schematic side view of a dishwasher according to the prior art.

FIG. 16 shows, in schematic side view, a dishwasher 30 according to the prior art.

Dishwasher 30 has a housing 31 providing a washing chamber 32. During normal use, washing chamber 32 serves to receive items to be washed, which may be dishes, cutlery pieces, and/or the like.

To permit loading of washing chamber 32 with items to be washed, a loading opening 33 is provided which is closed in a fluid-tight manner by a pivotally mounted appliance door 34.

To accommodate items to be washed, dishwasher 30 has washware carriers, which can be moved out of washing chamber 32 in direction of withdrawal 2 as needed by the user. After the user has loaded the washware carriers with items to be washed, the user can move them back into washing chamber 32 in a direction opposite to the direction of withdrawal 2.

In the exemplary embodiment shown, a lower rack 35, an upper rack 36, and a cutlery rack 1 are used as washware carriers. Cutlery rack 1 is used in particular to accommodate cutlery pieces to be cleaned and is configured in the manner provided by the invention, as will be apparent from the other FIGS. 1 through 15.

FIG. 1 shows, in schematic perspective view, a cutlery rack 1 according to the invention. As is known per se, cutlery rack 1 has a rack body 6 and cutlery inserts 5, which are used to accommodate cutlery pieces 4, as can be also seen in a portion of FIG. 2.

The cutlery rack 1 shown in FIG. 1 has a total of three cutlery inserts 5. There are provided a left cutlery insert 5 and a right cutlery insert as well as a central cutlery insert, as viewed in the plane of FIG. 1. As shown in FIG. 1, the right cutlery insert and the left cutlery insert 5 each serve to accommodate, inter alia, cutlery pieces 4, such as knives.

Cutlery insert 5, shown on the left in FIG. 1, is configured in the manner provided by the invention, as is the right cutlery insert in FIG. 1. For the sake of clarity, the invention will be described below only with reference to left cutlery insert 5. The right cutlery insert in FIG. 1 is configured correspondingly.

Cutlery insert 5 has a row of tines 7 for separately holding cutlery pieces 4 which are oriented transversely to the direction of withdrawal 2. As can be seen in particular from FIG. 2, this row of tines 7 includes a plurality of tines 9 arranged one behind the other in the direction of withdrawal 2, adjacent tines 9 being spaced apart from one another, forming a gap 10. During normal use, a cutlery item 4 is disposed in a gap 10 between two tines 9, whereby cutlery item 4 is securely held in a fixed position, as can be seen when viewing FIGS. 1 and 2 together.

Figure 2:
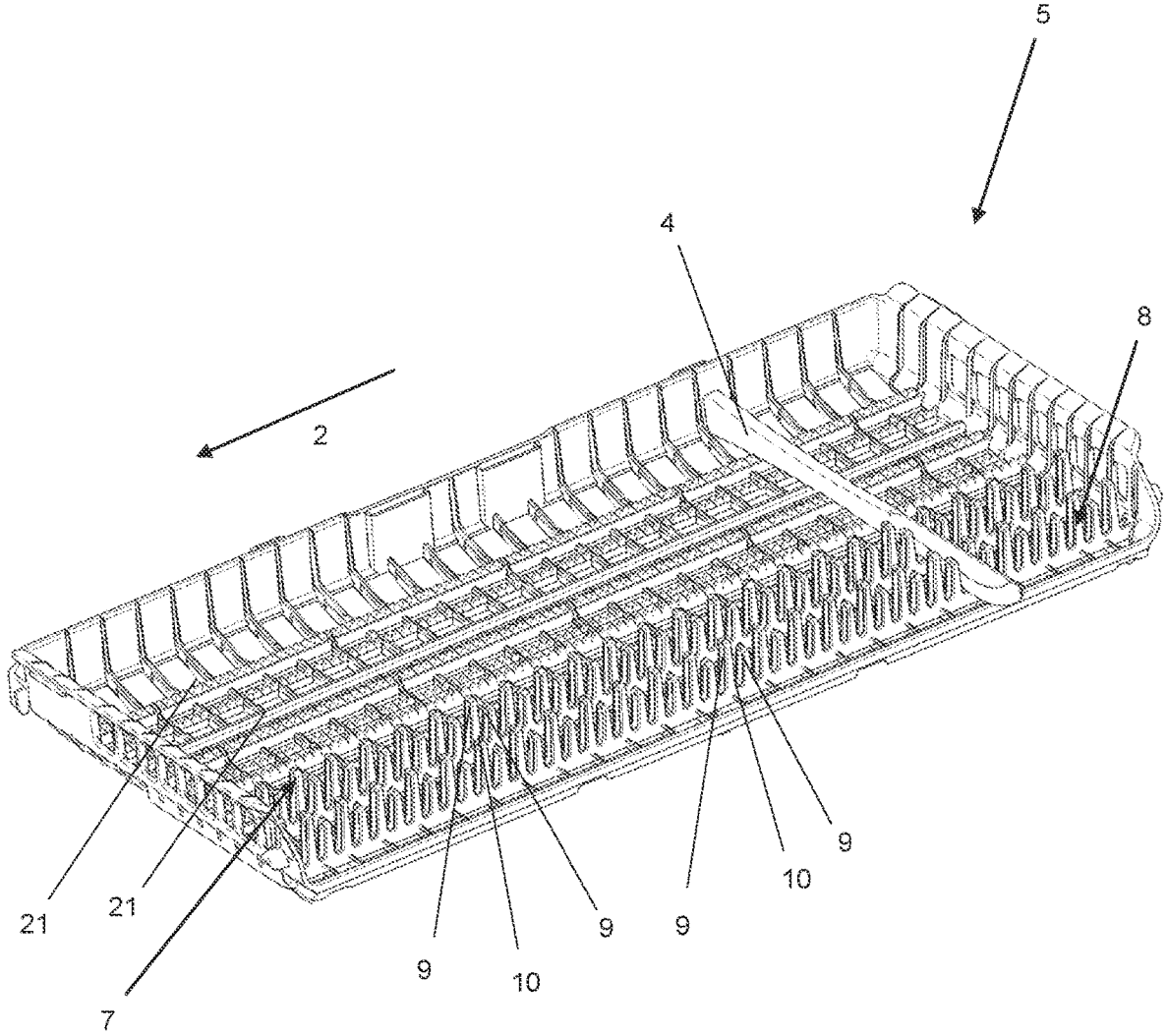
FIG. 2 is a schematic perspective view of a cutlery insert according to the invention.
Figure 3:
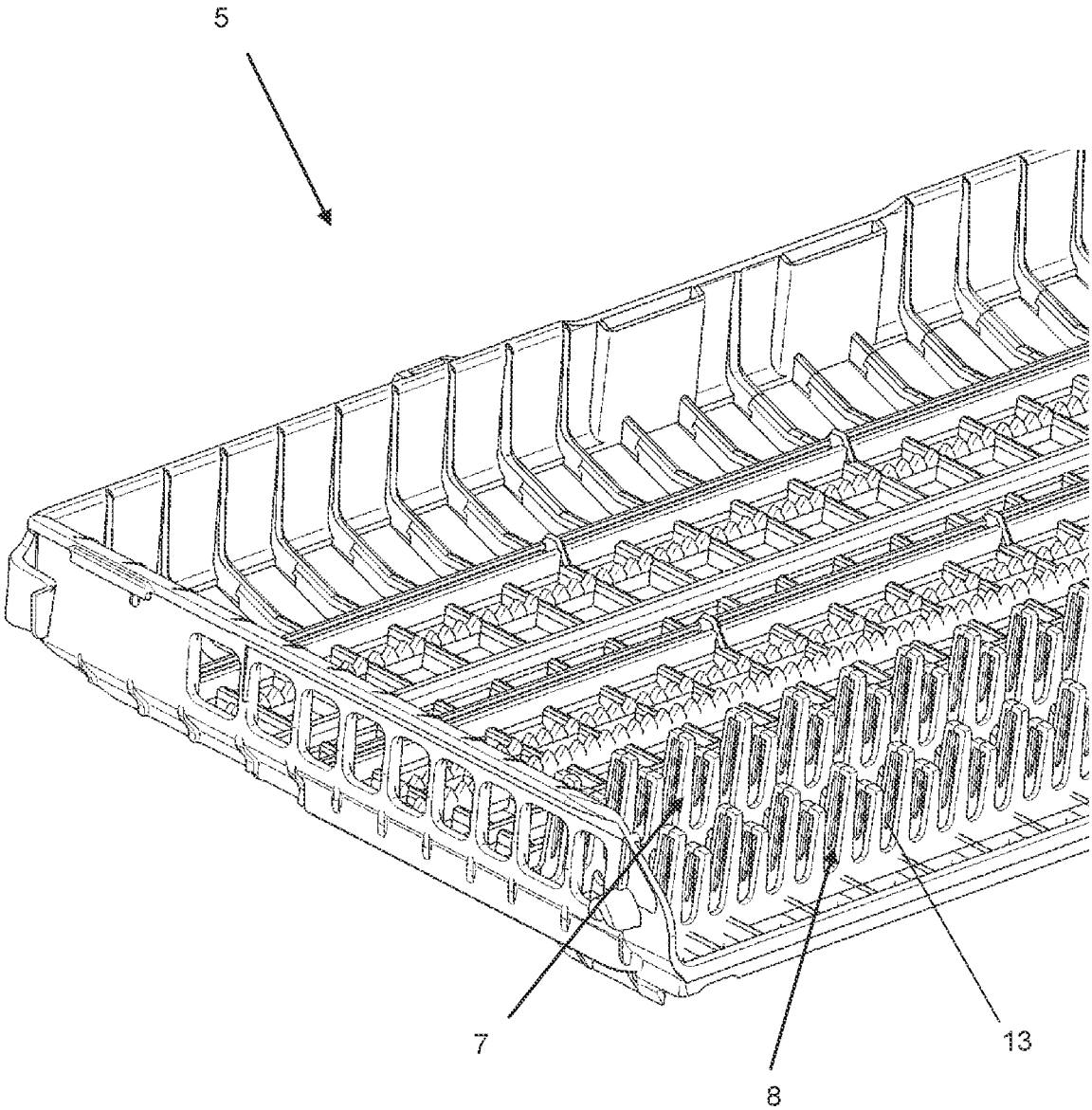
FIG. 3 is a schematic detail view of the cutlery insert of FIG. 2.
Figure 4:
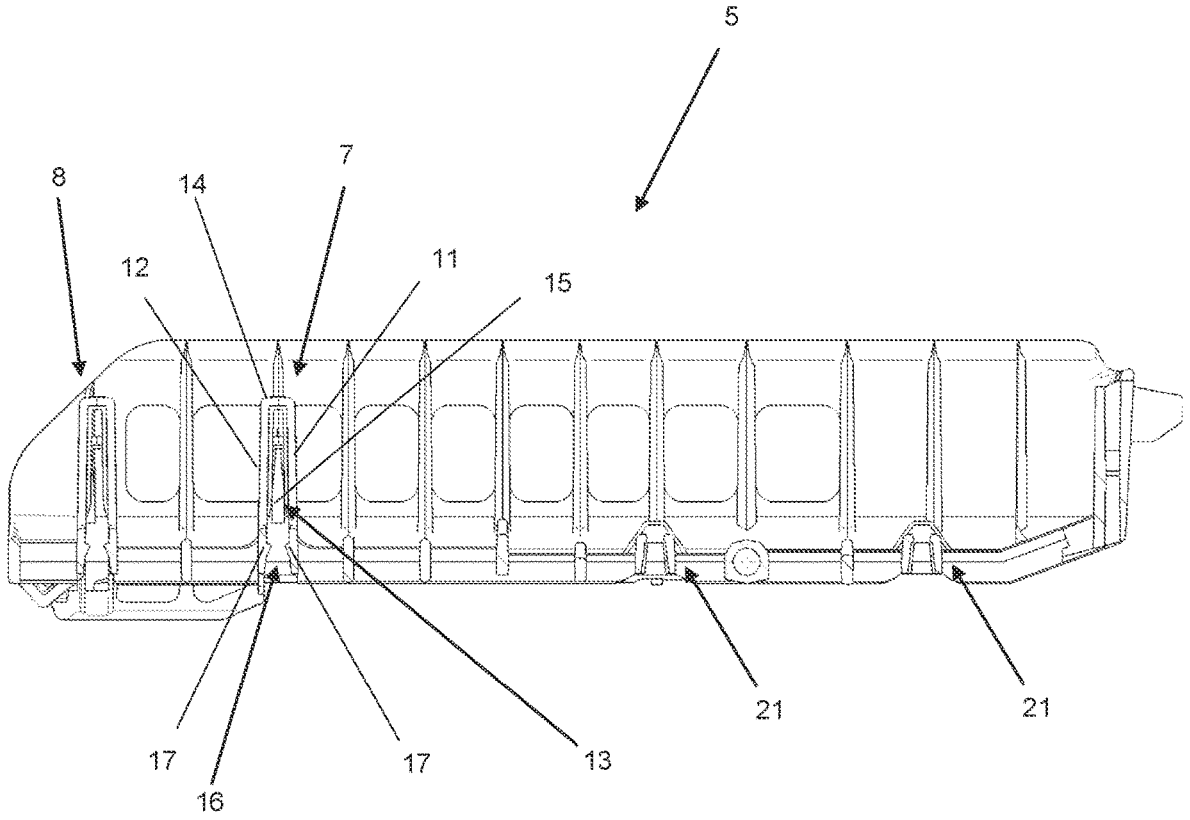
FIG. 4 is a cross-sectional side view of the cutlery insert of FIG. 2.
Figure 5:
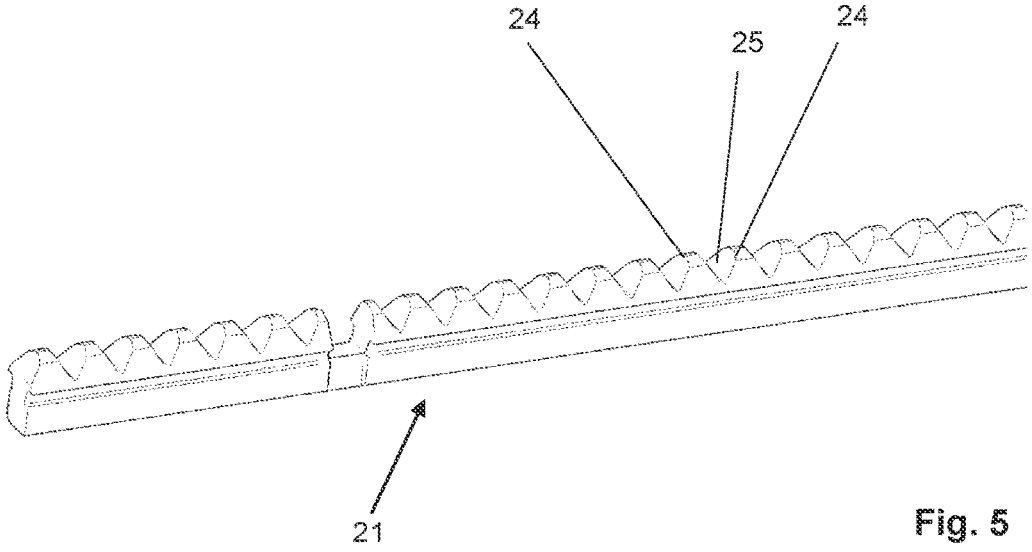
FIG. 5 is a schematic perspective view of a second tine strip.
Figure 6:
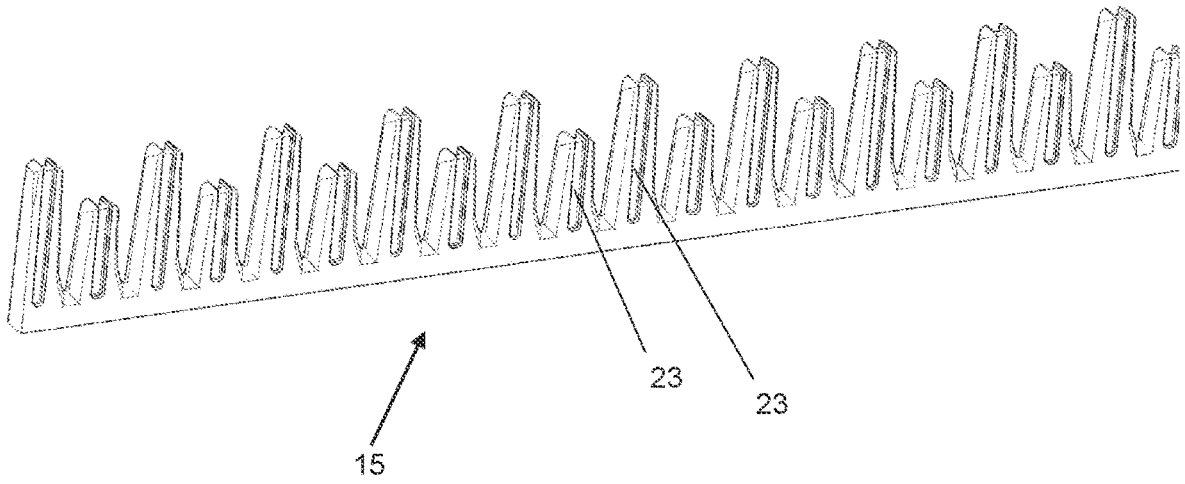
FIG. 6 is a schematic perspective view of a first tine strip.
Figure 7:
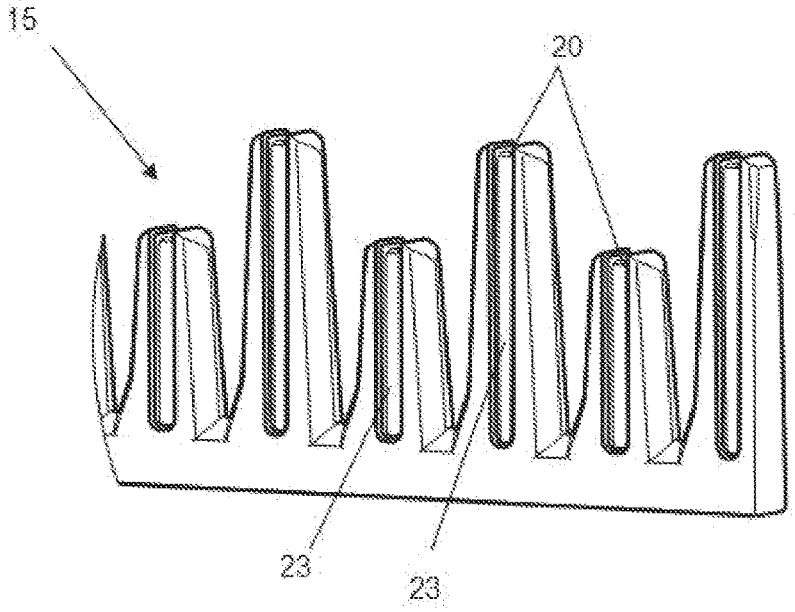
FIG. 7 is a schematic perspective view showing a detail of the first tine strip of FIG. 6.
Figure 8:
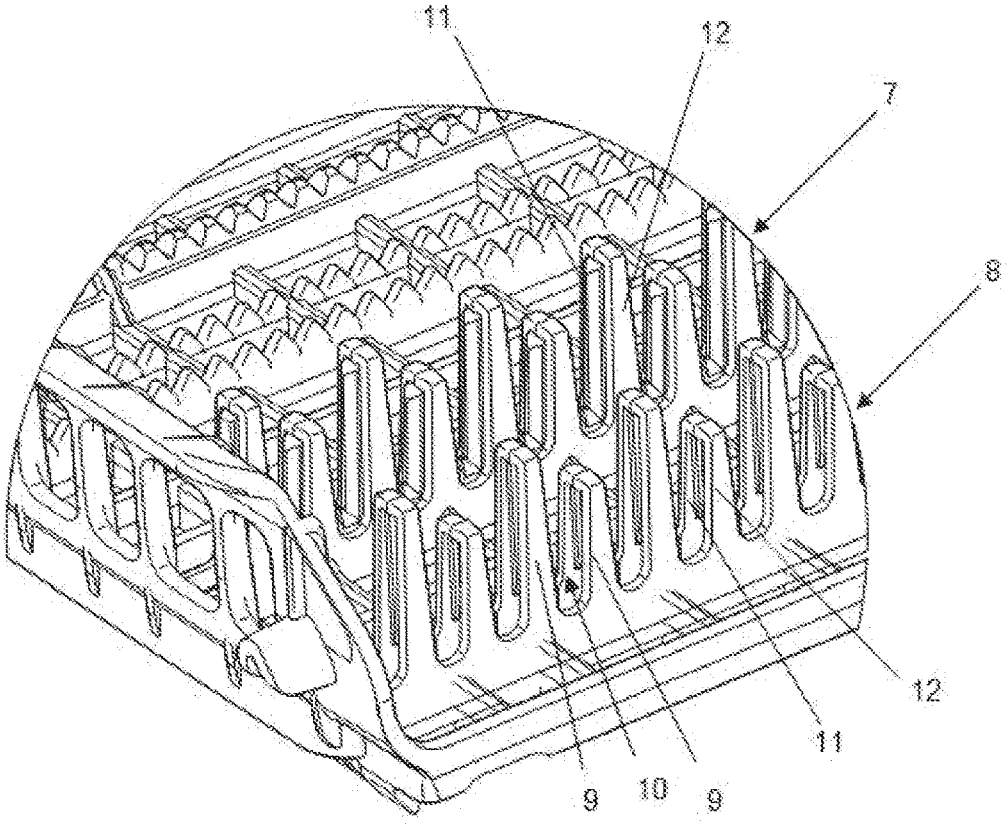
FIG. 8 is a schematic perspective view showing a detail of the cutlery insert of FIG. 2.

The cutlery insert 5 according to the embodiment shown in the figures not only has a first row of tines 7, but also a second row of tines 8, which is spaced apart from the first row of tines 7 in a direction 3 orthogonal to the direction of withdrawal 2, as can be seen in FIGS. 1 and 2. The formation of two rows of tines 7 and 8 further improves the retention in position of a cutlery piece 4 supported by the same. The rows of tines 7 and 8 are configured identically, which is why only the configuration of the row of tines 7 will be described below. The configuration of the row of tines 8 can be inferred correspondingly.

As can be seen in particular when viewing FIGS. 3, 4, 8, and 9 together, the row of tines 7 has two tine ridges 11 and 12 extending in the direction of withdrawal 2 and being spaced apart from each other transversely to the direction of withdrawal 2, leaving a gap space 13. In the final assembled state, this gap space 13 receives a tine strip 15, which is shown in schematic perspective view in FIG. 6.

Tine strip 15 is securely held in position in gap space 13 between the two tine ridges 11 and 12, for which purpose a suitable catch device 16 is provided. The configuration of catch device 16 can be seen in particular when viewing FIGS. 4, 12, and 16 together and will be described in more detail in the following.

The two tine ridges 11 and 12 of the first row of tines 7 are made of a relative hard plastic material in a manner known per se. In contrast, tine strip 15 is made of a relatively soft plastic material, such as, for example, silicone. Accordingly, the tine strip is made of a material that has a lower hardness than the material of tine ridges 11 and 12.

Figure 11:
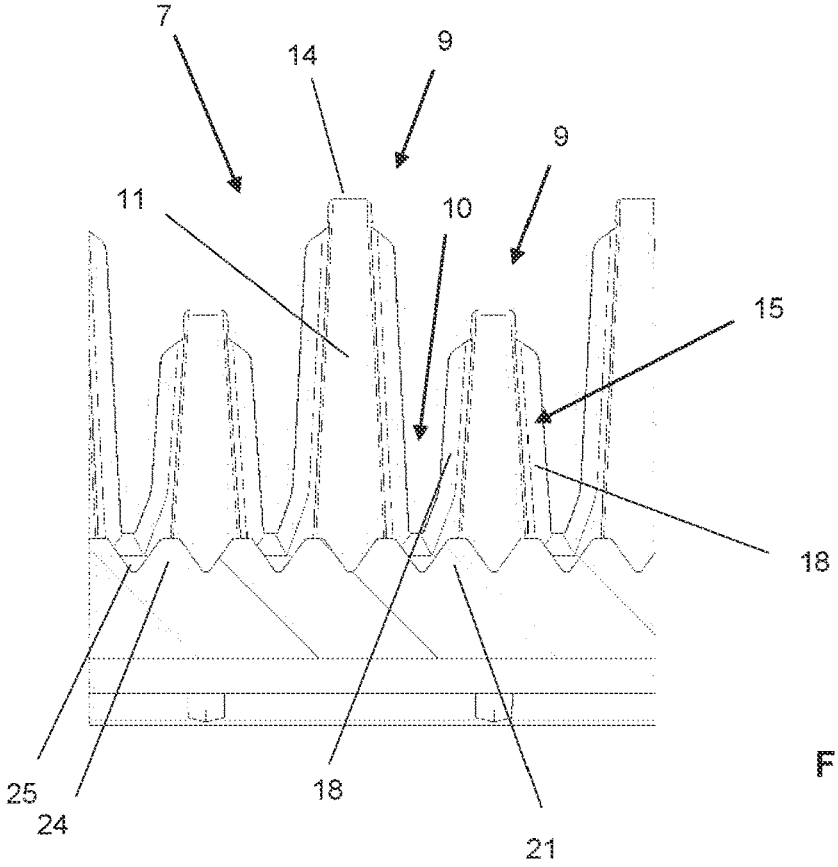
FIG. 11 is a partially cross-sectional side view showing a portion of the cutlery insert of FIG. 2.

As can be seen in particular from the illustration in FIG. 11, tine strip 15 projects beyond tine ridges 11 and 12 toward a respective gap 10 provided between two adjacent tines 9. This results in an overhang 18, against which cutlery pieces 4 properly supported on cutlery rack 1 rest during normal use. Thus, in a departure from the prior art, cutlery pieces 4 supported on cutlery rack 1 do not rest against the tine ridges 11 and 12 made of a relatively hard plastic material, but against the tine strip 15 made of a relatively soft plastic material. This advantageously allows cutlery pieces 4 to be accommodated in cutlery rack 1 in a material-friendly manner, thus minimizing accidental material abrasion caused by scratching of cutlery pieces 4.

Figure 9:
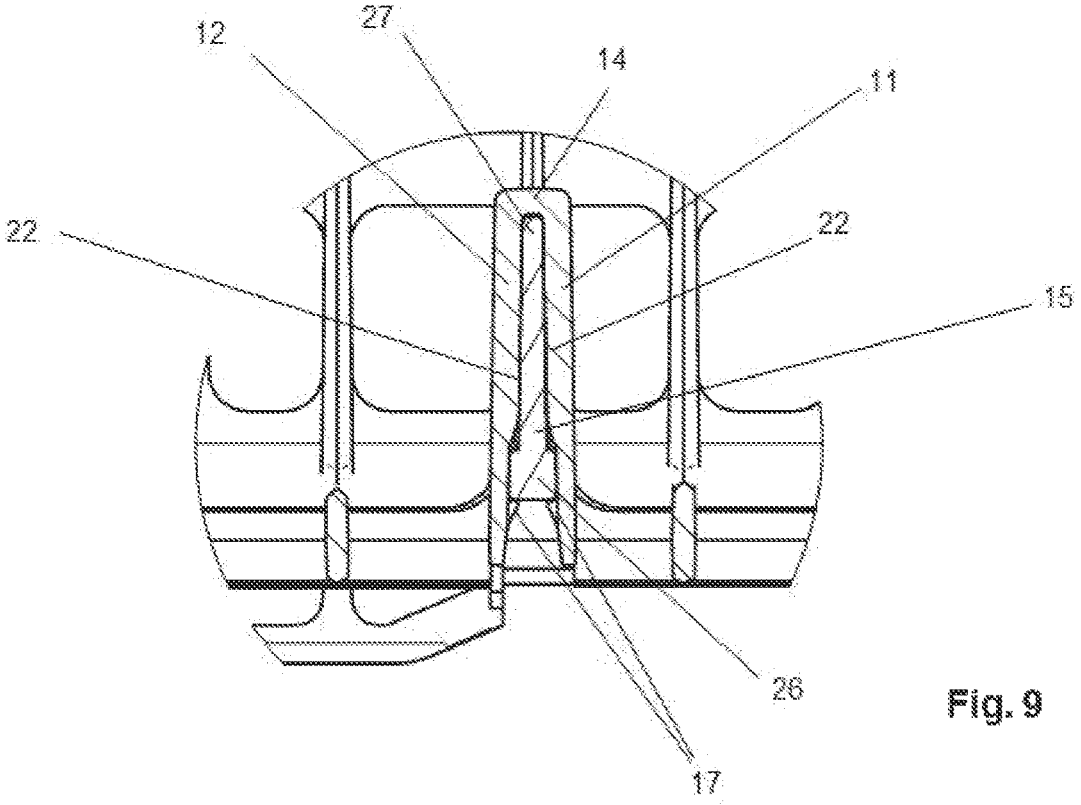
FIG. 9 is a schematic cross-sectional detail view of the cutlery insert of FIG. 2 with reference to the first tine strip.

As can be seen in particular from FIGS. 9 and 11, a bridging piece 14 is provided at each tine 9, the bridging piece extending at each tine 9 transversely to the direction of withdrawal 2 between the two tine ridges 11 and 12 and connecting them to each other. The tine ridges 11 and 12 and the bridging piece 14 connecting these two tine ridges 11 and 12 thus bound the gap space 13 that receives tine strip 15 in the final mounted state. The gap space is open in the direction of withdrawal 2, so that tine strip 15 can form, in the manner already described, the overhang 18 toward the respective gaps 10, against which cutlery pieces to be cleaned come to rest during normal use.

In the final mounted state, tine strip 15 is securely positioned on tine ridges 11 and 12, for which purpose catch device 16 is provided.

Catch device 16 includes locking hooks 17, as can be seen in particular in FIG. 9. At each tine 9, two locking hooks 17 are provided, against which the foot end of tine strip 15 rests in the final mounted state. As can be seen in particular in FIG. 9, foot 26 of tine strip 15 rests against and on top of locking hooks 17, so that tine strip 15 cannot migrate downward out of gap space 13.

Gap space 13 is closed vertically upwardly by bridging piece 14 in the manner already described. Bridging piece 14 thus serves as an abutment for tine strip 15, against which it bears by its head 27. As can be seen in the cross-sectional view of FIG. 9, tine strip 15 is clamped between bridging piece 14, which serves as an abutment, and looking hooks 17 at the foot end when in the final mounted state. Because of this, tine strip 15 cannot accidentally move in the vertical direction in relation to tine ridges 11 and 12 and is thus securely held in position.

Figure 12:
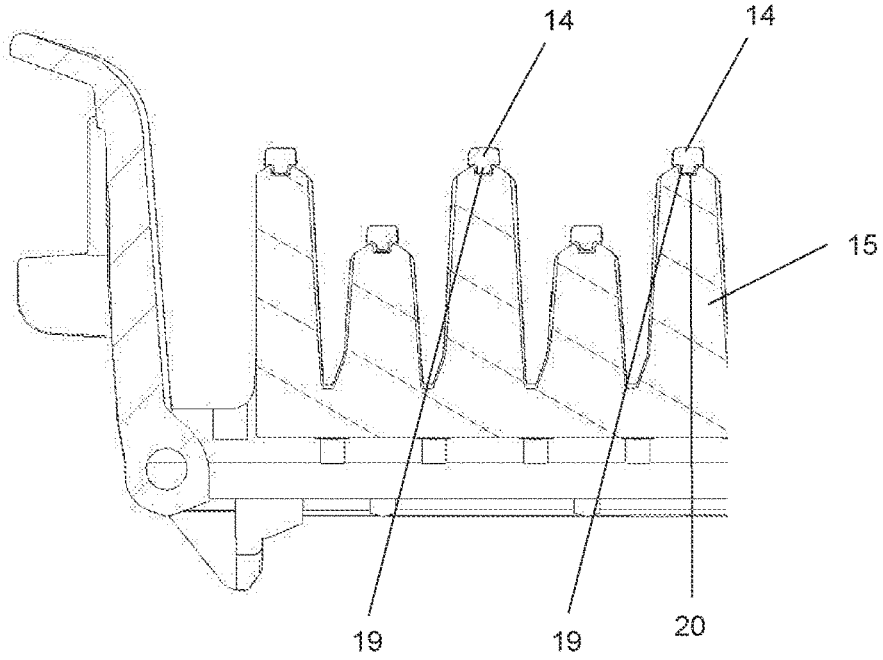
FIG. 12 is another detail schematic view of the cutlery insert of FIG. 2.

Catch device 16 further has ribs 19, which are disposed on the underside of a bridging piece 14 at each tine 9, as can be seen in FIG. 12. During normal use, such a rib 19 engages in an associated recess 20 of tine strip 15 at each tine 9. At each tine 9, tine strip 15 is thus secured in position at the head end against displacement and/or movement in the direction of withdrawal 2.

As can be seen when viewing FIGS. 6, 7, 9, 13, 14, and 15 together, tine strip 15 has vertically extending guide grooves 23 at each tine 9. Correspondingly shaped guide ribs 22 are provided which are formed on the inner sides of tine ridges 11 and 12. In the final assembled state, these guide ribs 22 on the tine ridges engage in the guide grooves 23 on the tine strip, whereby tine strip 15 is secured in position in the direction of withdrawal 2 in this way as well.

The formation of guide ribs 22 and guide grooves 23 also serves to facilitate the mounting of tine strip 15.

Figure 13:
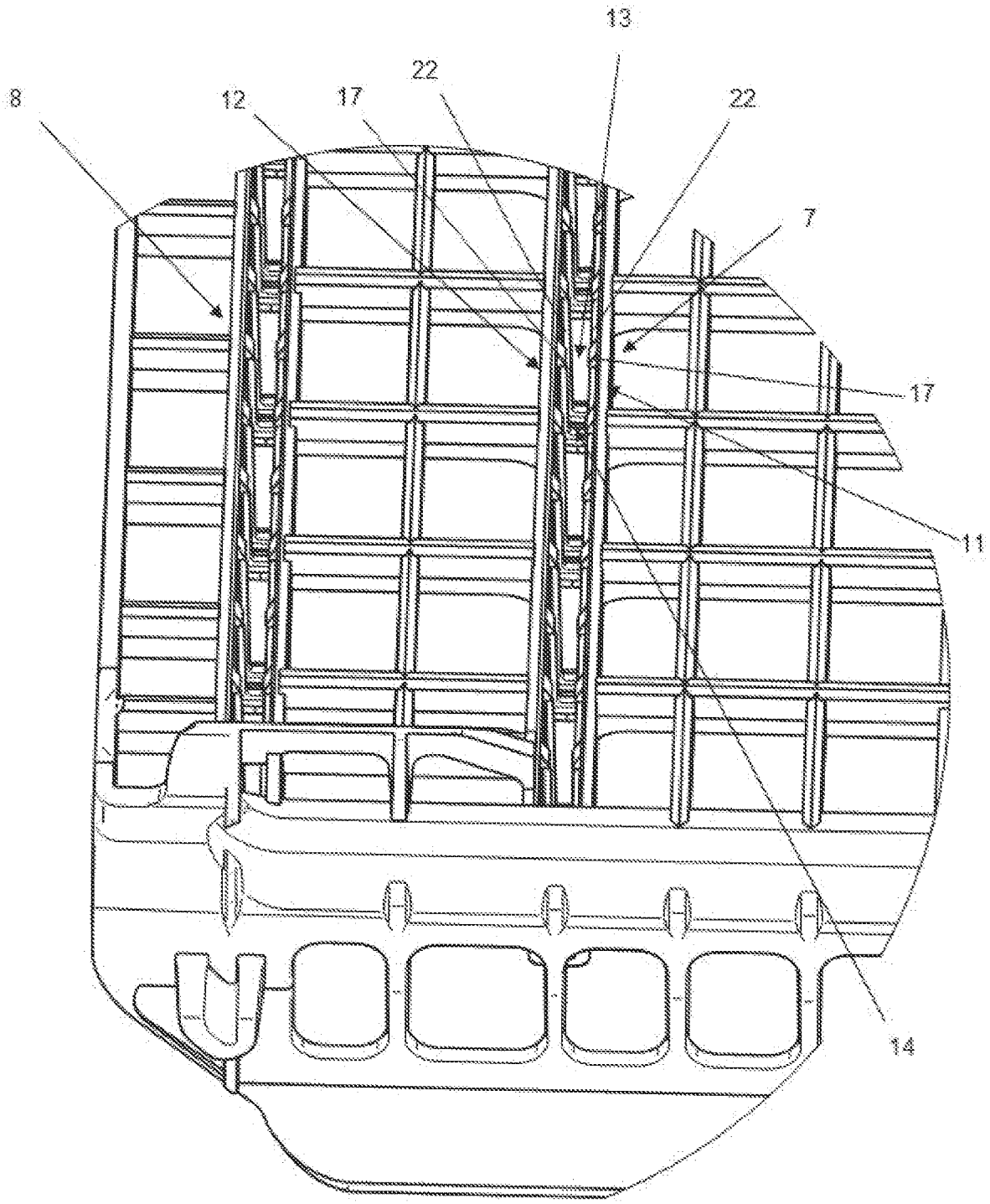
FIG. 13 is a schematic perspective view showing a portion of the cutlery insert of FIG. 2 from below.
Figure 14:
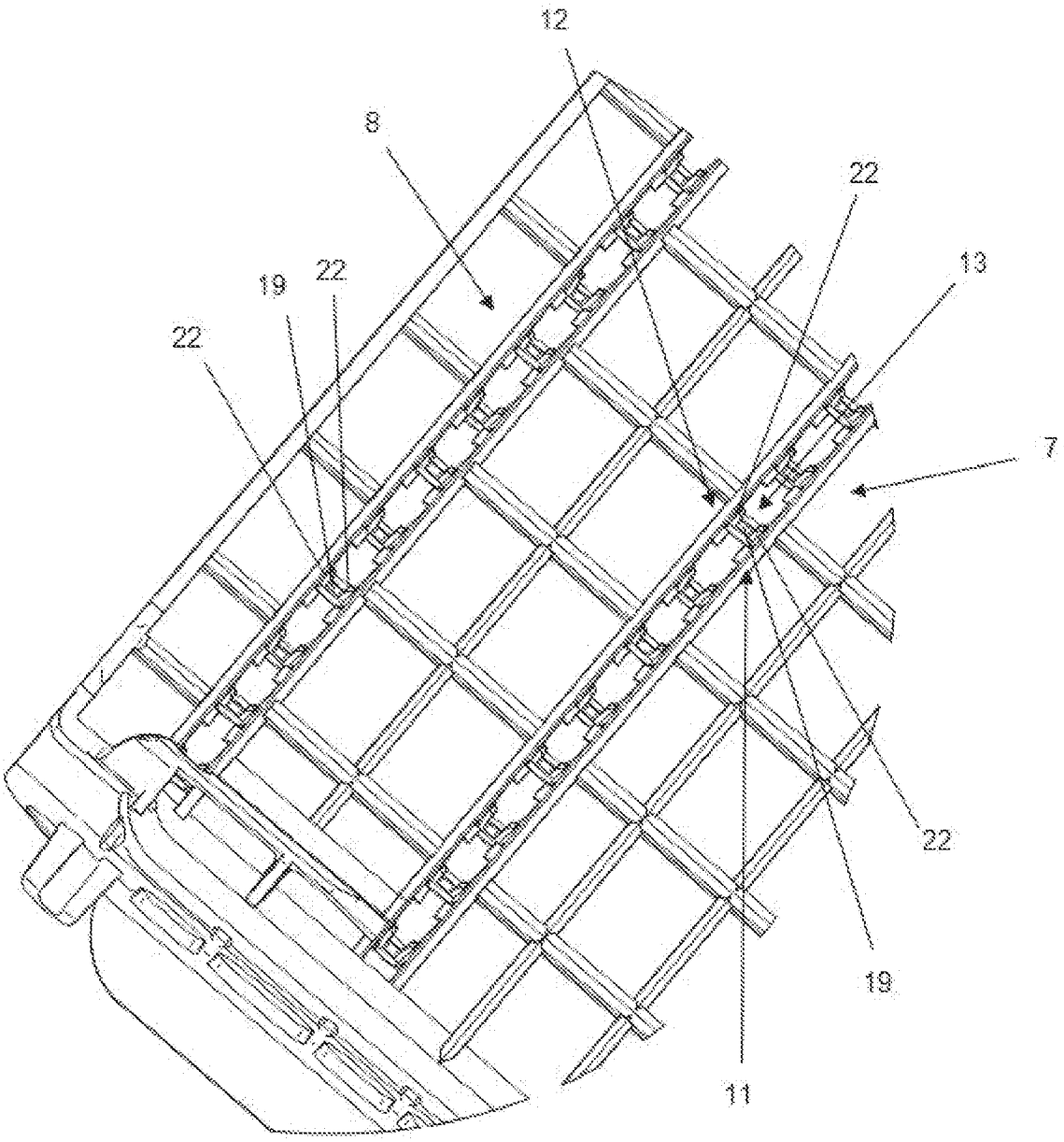
FIG. 14 is another schematic perspective view showing the cutlery insert of FIG. 2 from below.
Figure 15:
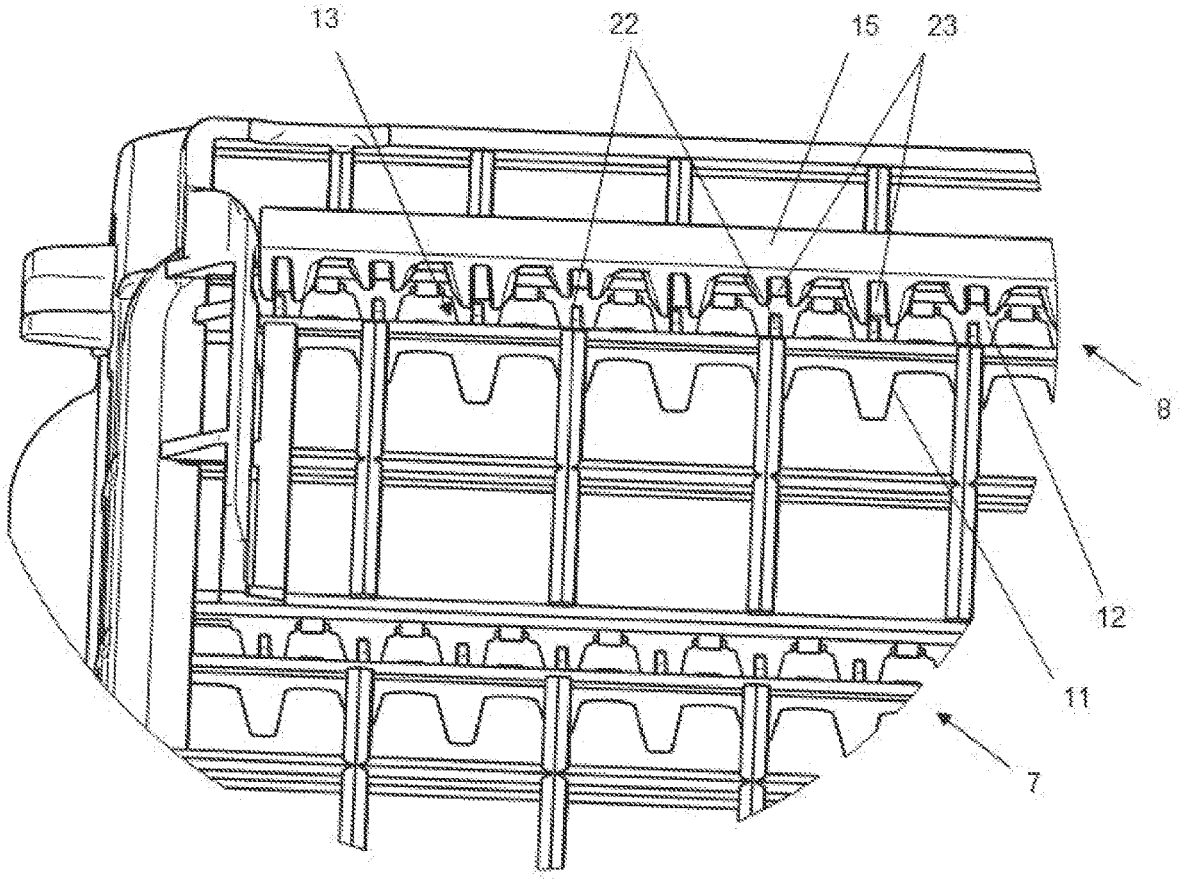
FIG. 15 is a schematic bottom view showing the cutlery insert of FIG. 2 at the moment when a tine strip is mounted.

As can be seen in particular when viewing FIGS. 13 through 15 together, the gap space 13 bounded by the two tine ridges 11 and 12 is accessible from below. Thus, gap space 13 is open at its vertically lower side. To finalize the assembly, tine strip 15 is inserted through this open side, as can be seen in FIG. 15. In this process, tine strip 15 is inserted vertically upwardly into gap space 13 until locking hooks 17 engage under guide strip 15 at the foot end thereof. In order to facilitate the insertion of tine strip 15 into gap space 13, guide ribs 22 and the correspondingly shaped guide grooves 23 serve as guide elements, as can be seen in particular in FIGS. 7, 13, 14, and 15.

In the embodiment shown, cutlery insert 5 has two rows of tines 7 and 8, the two rows of tines 7 and 8 being configured identically in accordance with the above explanations. During normal use, the two rows of tines 7 and 8 serve in particular to securely hold in position the functional portion of a cutlery piece 4, in the exemplary embodiment shown in FIG. 1, the blade of a knife. A second tine strip 21 as shown in schematic perspective view in FIG. 5 serves to support in particular the handle portion of cutlery piece 4.

Second tine strip 21 is also made of a relatively soft, elastic plastic material, such as, for example, silicone. In the final assembled state, second tine strip 21 is oriented such that it is spaced apart from first and second rows of tines 7, 8, transversely, preferably orthogonally, to the direction of withdrawal 2, as is illustrated by transverse direction 3 in FIG. 1.

The second tine strip in turn provides tines 24 and gaps 25 therebetween. The gaps 25 of the second tine strip are preferably aligned with the gaps 10 of the first and second rows of tines 7 and 8, so that in the final assembled state, cutlery pieces 4 can be held in transverse direction 3, as shown in FIG. 1.

Figure 10:
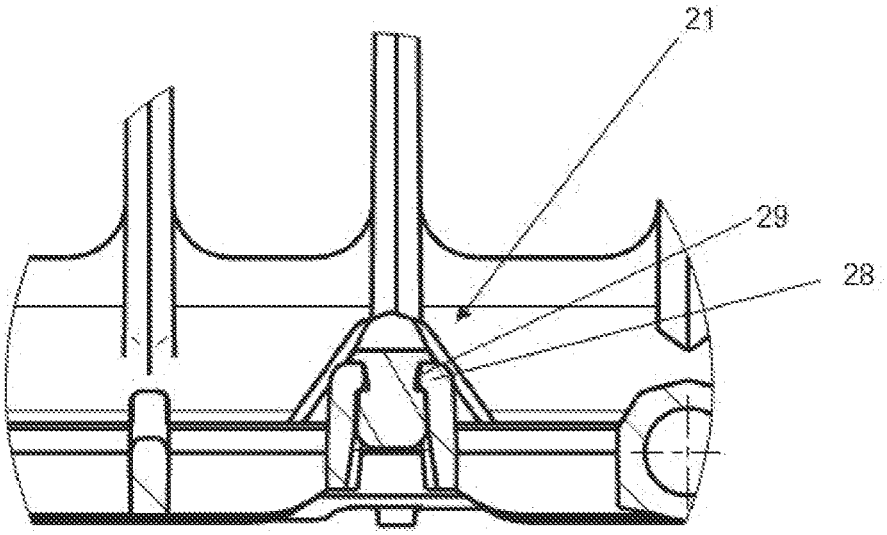
FIG. 10 is a schematic cross-sectional detail view of the cutlery insert of FIG. 2 with reference to the second tine strip.

Second tine strip 21 is latchingly mounted on cutlery insert 5, for which purpose the cutlery insert has latching strips 28 which, in the final assembled state, engage in grooves 29 provided by second tine strip 21, as can be seen in particular from FIG. 10.

The design according to the invention is characterized by its durability and, at the same time, by its robustness due to the relatively hard plastic material of tine ridges 11 and 12. Moreover, in combination with the tine strip 15 made of a soft, elastic plastic material for the rows of tines 7 and 8 and the second tine strip 21, a material-friendly seating surface is provided for cutlery pieces 4, which helps to preferably prevent accidental abrasion of material from cutlery pieces 4 caused by scratching.

First tine strips 15 of the rows or tines 7 and 8 and second tine strips 21 are each replaceably mounted on cutlery insert 5, which allows for replacement if necessary. Tine strips 15 and 21 are each latchingly mounted and securely held in place on cutlery insert 5, so that relative movements in comparison to cutlery insert 5 are prevented. This advantageously ensures that cutlery pieces 4 are accommodated in cutlery insert 5 in a positionally secure manner.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 cutlery rack
2 direction of withdrawal
3 transverse direction
4 cutlery piece
5 cutlery insert
6 rack body
7 first row of tines
8 second row of tines
9 tine
10 gap
11 tine ridge
12 tine ridge
13 gap space
14 bridging piece
15 tine strip
16 catch device
17 locking hook
18 overhang
19 rib
20 recess
21 second tine strip
22 guide rib
23 guide groove
24 tine
25 gap
26 foot
27 head
28 latching strip
29 groove
30 dishwasher
31 housing
32 washing chamber
33 loading opening
34 appliance door
35 lower rack
36 upper rack

The invention claimed is:

1. A cutlery rack for a dishwasher, comprising:

a rack body which is mounted so as to be withdrawn from a washing chamber of the dishwasher in a direction of withdrawal and provides a cutlery insert for accommodating in particular cutlery pieces, the cutlery insert having a row of tines for separately receiving cutlery pieces that are oriented transversely to the direction of withdrawal, which row of tines includes a plurality of tines arranged one behind another in the direction of withdrawal, adjacent tines being spaced apart from one another, forming a gap, wherein the row of tines has two tine ridges extending in the direction of withdrawal and being spaced apart from each other transversely to the direction of withdrawal, leaving a gap space, wherein a tine strip is provided which is received in the gap space between the two tine ridges, and wherein a catch device is provided by which the tine strip is securely held in position by the tine ridges, the tine strip projecting beyond the tine ridges toward a gap provided between two adjacent tines and comprising a material that has a lower hardness than a material of the tine ridges.

2. The cutlery rack of claim 1, wherein the tine strip comprises a soft, elastic plastic material, preferably silicone.

3. The cutlery rack of claim 1, wherein the catch device includes locking hooks on the tine ridges, against which a foot end of the tine strip rests in a final mounted state.

4. The cutlery rack of claim 3, wherein the catch device includes abutments on the tines, the abutments being formed opposite the locking hooks, and a head end of the tine strip bearing thereagainst in the final mounted state.

5. The cutlery rack of claim 4, wherein the abutment is formed by a bridging piece which extends transversely to the direction of withdrawal between the tine ridges at each tine.

6. The cutlery rack of claim 5, wherein the bridging piece has a rib at an underside thereof facing the tine strip, which rib engages in a correspondingly shaped recess of the tine strip when the tine strip is in the final mounted state.

7. The cutlery rack of claim 1, wherein the tine ridges each have a guide rib on facing sides thereof at each tine, each guide rib engaging in a guide groove provided by the tine strip when the tine strip is in a final mounted state.

8. The cutlery rack of claim 1, further comprising:

a second tine strip comprising a soft, elastic plastic material, preferably silicone, and spaced apart from the row of tines transversely to the direction of withdrawal.

9. The cutlery rack of claim 8, wherein the second tine strip is latchingly mounted on the cutlery insert, for which purpose the cutlery insert has latching strips which, in the final assembled state, engage in grooves provided by the tine strip.

10. The cutlery rack of claim 8, wherein the second tine strip provides tines which are arranged one behind another in the direction of withdrawal, adjacent tines being spaced apart from one another, forming a gap, a gap of the second tine strip being aligned in a direction orthogonal to the direction of withdrawal with a gap between two tines of the first row of tines.

11. A dishwasher, in particular a household dishwasher, comprising:

an appliance housing providing a washing chamber, which appliance housing has a loading opening for access to the washing chamber, and having an appliance door which is mounted so as to be rotatable about a pivot axis for closing the loading opening; and the cutlery rack of claim 1.

* * * * *